US012686481B2

(12) United States Patent
Ito

(10) Patent No.: US 12,686,481 B2
(45) Date of Patent: Jul. 21, 2026

(54) SYSTEM FOR AND METHOD OF CONTROLLING WATERCRAFT

(71) Applicant: YAMAHA HATSUDOKI KABUSHIKI KAISHA, Iwata (JP)

(72) Inventor: Makoto Ito, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 55 days.

(21) Appl. No.: 18/741,849

(22) Filed: Jun. 13, 2024

(65) Prior Publication Data

US 2025/0074569 A1 Mar. 6, 2025

(30) Foreign Application Priority Data

Aug. 31, 2023 (JP) ..... 2023-140858

(51) Int. Cl.
*B63H 21/21* (2006.01)
*B63B 79/10* (2020.01)
*B63B 79/40* (2020.01)

(52) U.S. Cl.
CPC ..... *B63H 21/213* (2013.01); *B63B 79/10* (2020.01); *B63B 79/40* (2020.01); *B63H 2021/216* (2013.01)

(58) Field of Classification Search
CPC ..... B63B 34/10; B63B 79/10; B63B 79/40; B63C 9/0005; B63H 2021/216; B63H 21/21; B63H 21/213; B63H 25/02; B63H 25/42
See application file for complete search history.

(56) References Cited

U.S. PATENT DOCUMENTS 4,619,231 A * 10/1986 Stolar ..... B60K 31/0058 123/333
7,081,028 B1 * 7/2006 Crane ..... B63C 9/0005 440/84
7,497,181 B2 * 3/2009 Viggiano ..... B63C 9/0005 340/539.21
8,392,049 B2 * 3/2013 Goodwin ..... B62D 6/00 180/321

(Continued)

FOREIGN PATENT DOCUMENTS

JP 2017-159679 A 9/2017

*Primary Examiner* — Adam R Mott
*Assistant Examiner* — Abigail Lee Espinoza
(74) *Attorney, Agent, or Firm* — Keating & Bennett, LLP

(57) ABSTRACT

A system for controlling a watercraft includes a sensor to detect a position of a watercraft user, and a controller. When the watercraft user is not in an allowed area including a watercraft operating position, the controller is configured or programmed to stop a marine propulsion device or control the marine propulsion device to decelerate a watercraft. When the watercraft user is in a first region, the controller is configured or programmed to control the marine propulsion device in accordance with how a watercraft operator is operated. When the watercraft user is in a second region farther from the watercraft operating position than the first region but within the allowed area, the controller is configured or programmed to lock the watercraft operator. The controller is configured or programmed to disable an operation performed on the watercraft operator while the watercraft operator is locked.

14 Claims, 8 Drawing Sheets

(56) References Cited

U.S. PATENT DOCUMENTS

| | | | | |
|---|---|---|---|---|
| 2004/0231642 | A1* | 11/2004 | Ito | F02D 9/1095 123/399 |
| 2005/0003716 | A1* | 1/2005 | Takashima | B63J 99/00 440/85 |
| 2005/0017855 | A1* | 1/2005 | Harvey | G08G 1/207 340/426.1 |
| 2017/0253310 | A1 | 9/2017 | Hashizume et al. | |
| 2020/0255104 | A1* | 8/2020 | Gonring | B63H 21/21 |

* cited by examiner

SYSTEM FOR AND METHOD OF CONTROLLING WATERCRAFT

CROSS REFERENCE TO RELATED APPLICATIONS

This application claims the benefit of priority to Japanese Patent Application No. 2023-140858 filed on Aug. 31, 2023. The entire contents of this application are hereby incorporated herein by reference.

BACKGROUND OF THE INVENTION

1. Field of the Invention

The present invention relates to systems for and methods of controlling watercraft.

2. Description of the Related Art

A watercraft user is equipped with or wears a lanyard for urgently stopping a watercraft in an emergency. A conductive pin, inserted into an ignition circuit of an engine, is connected to the lanyard. When the watercraft user falls into the water from the watercraft, the conductive pin is pulled out of the ignition circuit by the weight of the watercraft user so that the engine is stopped.

On the other hand, there has been known a system for detecting the falling of a watercraft user into the water by wireless signals transmitted from a transmitter that the watercraft user wears. For example, Japan Laid-open Patent Application Publication No. 2017-159679 describes an emergency stop device that determines whether the watercraft user has encountered an abnormal situation when the intensity of radio wave signals transmitted from the transmitter is less than a specified value. When it is determined that the watercraft user has encountered the abnormal situation, the emergency stop device stops an engine of an outboard motor.

SUMMARY OF THE INVENTION

In the emergency stop device described above, unless the intensity of the radio wave signals transmitted from the transmitter becomes less than the specified value, the outboard motor is able to be operated even if the watercraft user is away from a cockpit. Because of this, chances are that, while the watercraft user is away from the cockpit, anyone on board the watercraft other than the watercraft user, may erroneously operate the outboard motor by erroneously touching an operating lever of the outboard motor.

Example embodiments of the present invention stop or decelerate watercraft when a watercraft user falls into the water and inhibit a marine propulsion device from being erroneously operated while the watercraft user is away from a watercraft operating position.

A system according to an example embodiment of the present invention relates to a system for controlling a watercraft. The watercraft includes a marine propulsion device and a watercraft operator. The watercraft operator is operable by a watercraft user of the watercraft at a watercraft operating position in the watercraft. The system includes a sensor and a controller. The sensor is operable to detect a location of the watercraft user. The controller is configured or programmed to determine whether the watercraft user is in an allowed area including the watercraft operating position. The controller is configured or programmed to stop the marine propulsion device or control the marine propulsion device to decelerate the watercraft when the watercraft user is not in the allowed area. The controller is configured or programmed to determine whether the watercraft user is in a first region within the allowed area. The controller is configured or programmed to control the marine propulsion device in accordance with how the watercraft operator is operated when the watercraft user is in the first region. The controller is configured or programmed to determine whether the watercraft user is in a second region farther from the watercraft operating position than the first region but within the allowed area. The controller is configured or programmed to lock the watercraft operator when the watercraft user is in the second region. The controller is configured or programmed to disable an operation performed on the watercraft operator while the watercraft operator is being locked.

A method according to an example embodiment of the present invention relates to a method of controlling a watercraft. The watercraft includes a marine propulsion device and a watercraft operator. The watercraft operator is operable by a watercraft user of the watercraft at a watercraft operating position in the watercraft. The method according includes detecting a location of the watercraft user, determining whether the watercraft user is in an allowed area including the watercraft operating position, stopping the marine propulsion device or controlling the marine propulsion device to decelerate the watercraft when the watercraft user is not in the allowed area, determining whether the watercraft user is in a first region within the allowed area, controlling the marine propulsion device in accordance with how the watercraft operator is operated when the watercraft user is in the first region, determining whether the watercraft user is in a second region farther from the watercraft operating position than the first region but within the allowed area, locking the watercraft operator when the watercraft user is in the second region, and disabling an operation performed on the watercraft operator while the watercraft operator is locked.

According to example embodiments of the present invention, when the watercraft user is not in the allowed area including the watercraft operating position, the marine propulsion device is stopped or controlled to decelerate the watercraft. The watercraft is thus stopped or decelerated when the watercraft user falls into the water. On the other hand, when the watercraft user is in the second region farther from the watercraft operating position than the first region but within the allowed area, the watercraft operator is locked so that any operation performed on the watercraft operator is disabled. Because of this, the marine propulsion device is inhibited from being erroneously operated while the watercraft user is away from the watercraft operating position.

The above and other elements, features, steps, characteristics and advantages of the present invention will become more apparent from the following detailed description of the example embodiments with reference to the attached drawings.

DETAILED DESCRIPTION OF THE EXAMPLE EMBODIMENTS

Figure 1:
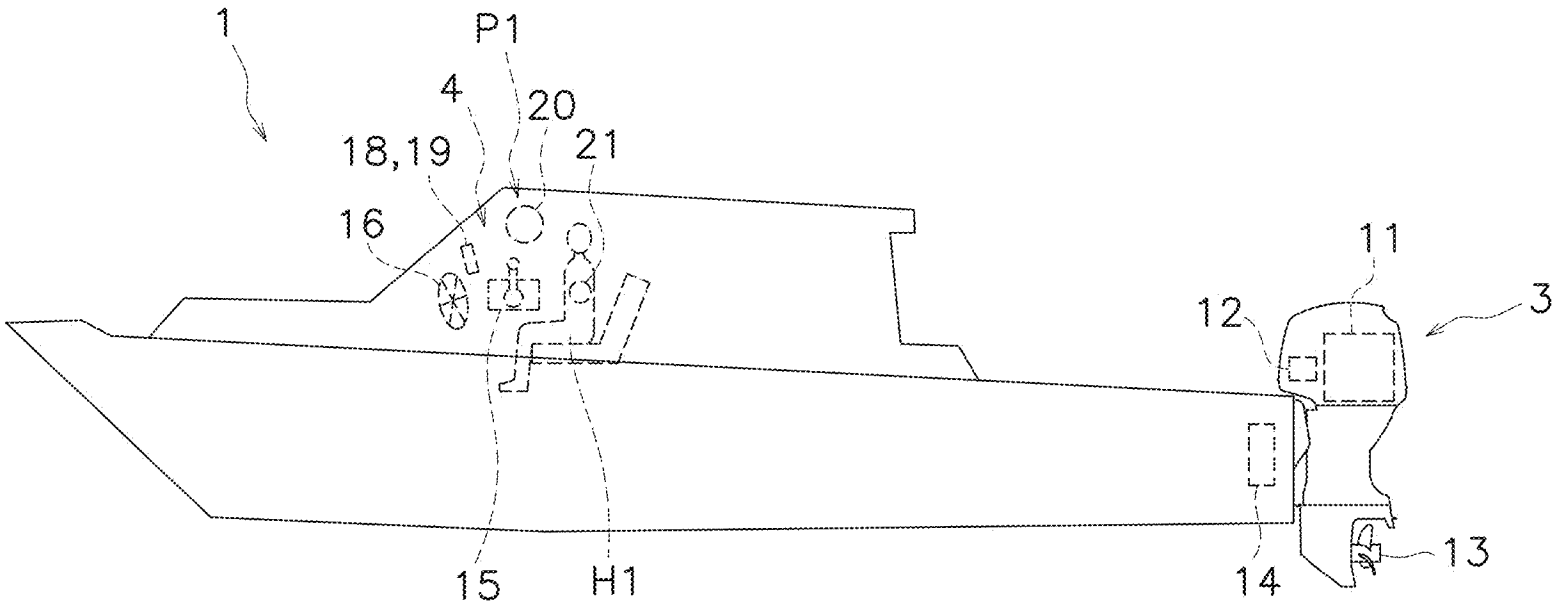
FIG. 1 is a side view of a watercraft according to an example embodiment of the present invention.
Figure 2:
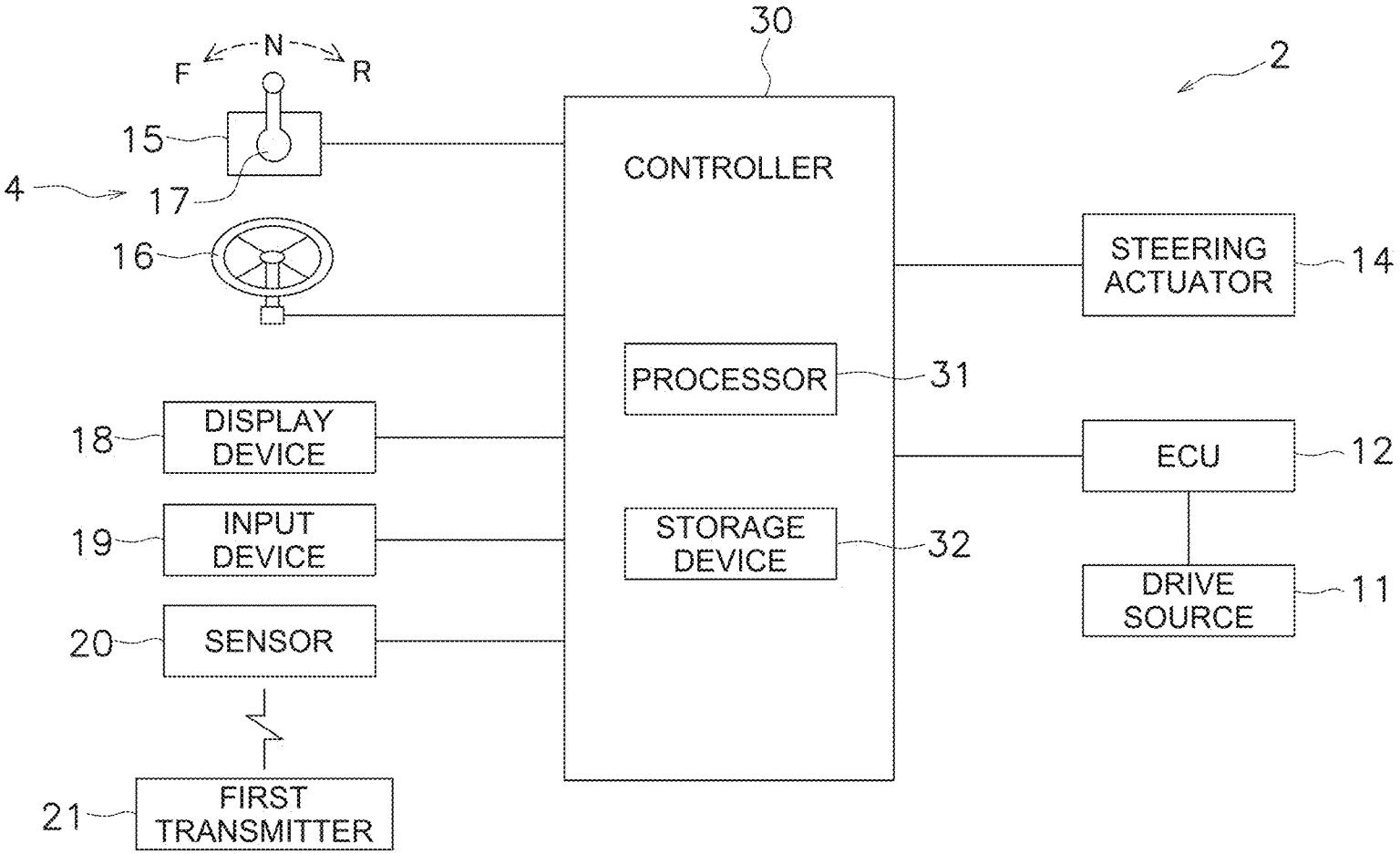
FIG. 2 is a block diagram showing a configuration of a system for controlling the watercraft according to an example embodiment of the present invention.

Systems for controlling watercraft according to example embodiments of the present invention will be hereinafter explained with reference to drawings. FIG. 1 is a side view of a watercraft 1 according to an example embodiment. FIG. 2 is a block diagram showing a configuration of a system 2 for controlling the watercraft 1 according to an example embodiment. As shown in FIG. 1, the watercraft 1 includes a marine propulsion device 3 and a watercraft operator 4.

The marine propulsion device 3 is, for instance, an outboard motor. The marine propulsion device 3 includes a drive source 11 and an ECU 12. The ECU 12 includes, for instance, a processor and memories. The ECU 12 controls the drive source 11. The drive source 11 includes, for instance, an internal combustion engine. Alternatively, the drive source 11 may include an electric motor. The drive source 11 drives and rotates a propeller 13 attached to the marine propulsion device 3. The marine propulsion device 3 thus generates a thrust to propel the watercraft 1.

The watercraft 1 includes a steering actuator 14. The steering actuator 14 includes, for instance, a hydraulic cylinder. Alternatively, the steering actuator 14 may include a hydraulic motor, an electric cylinder, or an electric motor. The steering actuator 14 turns the marine propulsion device 3 right and left to change a rudder angle of the marine propulsion device 3.

The watercraft operator 4 is operable by a watercraft user of the watercraft 1 at a watercraft operating position in the watercraft 1. The watercraft operator 4 includes a throttle operator 15 and a steering operator 16. The throttle operator 15 switches an output of the drive source 11 and a moving direction of the watercraft 1. As shown in FIG. 2, the throttle operator 15 includes a throttle lever 17. The throttle lever 17 is operable from a neutral position N to a forward moving direction F and a rearward moving direction R. The steering operator 16 steers the watercraft 1 right and left. The steering operator 16 includes, for instance, a steering wheel.

The watercraft 1 includes a display 18 and an input device 19. The display 18 displays information regarding the watercraft 1. The display 18 includes, for instance, a display such as an LED (Liquid Crystal Display) or OELD (Organic Electro-Luminescence Display). Alternatively, the display 18 may include a lamp such as a warning light. The input device 19 sets the controls for the watercraft 1. For example, the input device 19 sets an autopilot control for the watercraft 1. The input device 19 includes, for instance, a touch-screen. Alternatively, the input device 19 may include one or more physical switches such as one or more buttons.

The watercraft 1 includes a sensor 20 disposed at the watercraft operating position (P1). The watercraft operating position P1 refers to a position in the watercraft 1 at which the watercraft user (H1) operates the watercraft operator 4. The sensor 20 detects a location of the watercraft user H1. The watercraft user H1 is equipped with a first transmitter 21. The first transmitter 21 is portable and is attachable to the body of the watercraft user H1. The first transmitter 21 transmits radio wave signals. The sensor 20 is a receiver that receives the radio wave signals transmitted from the first transmitter 21. The sensor 20 detects a position of the first transmitter 21 as the location of the watercraft user H1 based on the radio wave signals transmitted from the first transmitter 21.

The watercraft 1 includes a controller 30. The controller 30 includes a processor 31 and a storage device 32. The storage device 32 stores programs and data to control the watercraft 1. The processor 31 controls the watercraft 1 based on the programs and data that control the watercraft 1.

For example, the controller 30 is configured or programmed to receive a signal, indicating an operating position of the throttle lever 17, from the throttle operator 15. The controller 30 is configured or programmed to control the output of the drive source 11 based on the operating position of the throttle lever 17. A moving speed of the watercraft 1 is thus controlled. Additionally, the controller 30 is configured or programmed to control a rotational direction of the propeller 13 based on the operating position of the throttle lever 17. Movement of the watercraft 1 is thus switched among forward movement, rearward movement, and stoppage.

The controller 30 is configured or programmed to receive a signal, indicating an operating position of the steering operator 16, from the steering operator 16. The controller 30 is configured or programmed to control the steering actuator 14 based on the operating position of the steering operator 16 such that the rudder angle of the marine propulsion device 3 is changed right and left. The watercraft 1 thus turns right and left.

The controller 30 is configured or programmed to receive the radio wave signals, transmitted from the first transmitter 21, via the sensor 20. The controller 30 is configured or programmed to execute a determination regarding the location of the watercraft user H1 based on the radio signals transmitted from the first transmitter 21. The controller 30 is configured or programmed to execute a control to prevent the marine propulsion device 3 from being erroneously operated based on the location of the watercraft user H1. The control to prevent the marine propulsion device 3 from being erroneously operated will be hereinafter explained.

Figure 3:
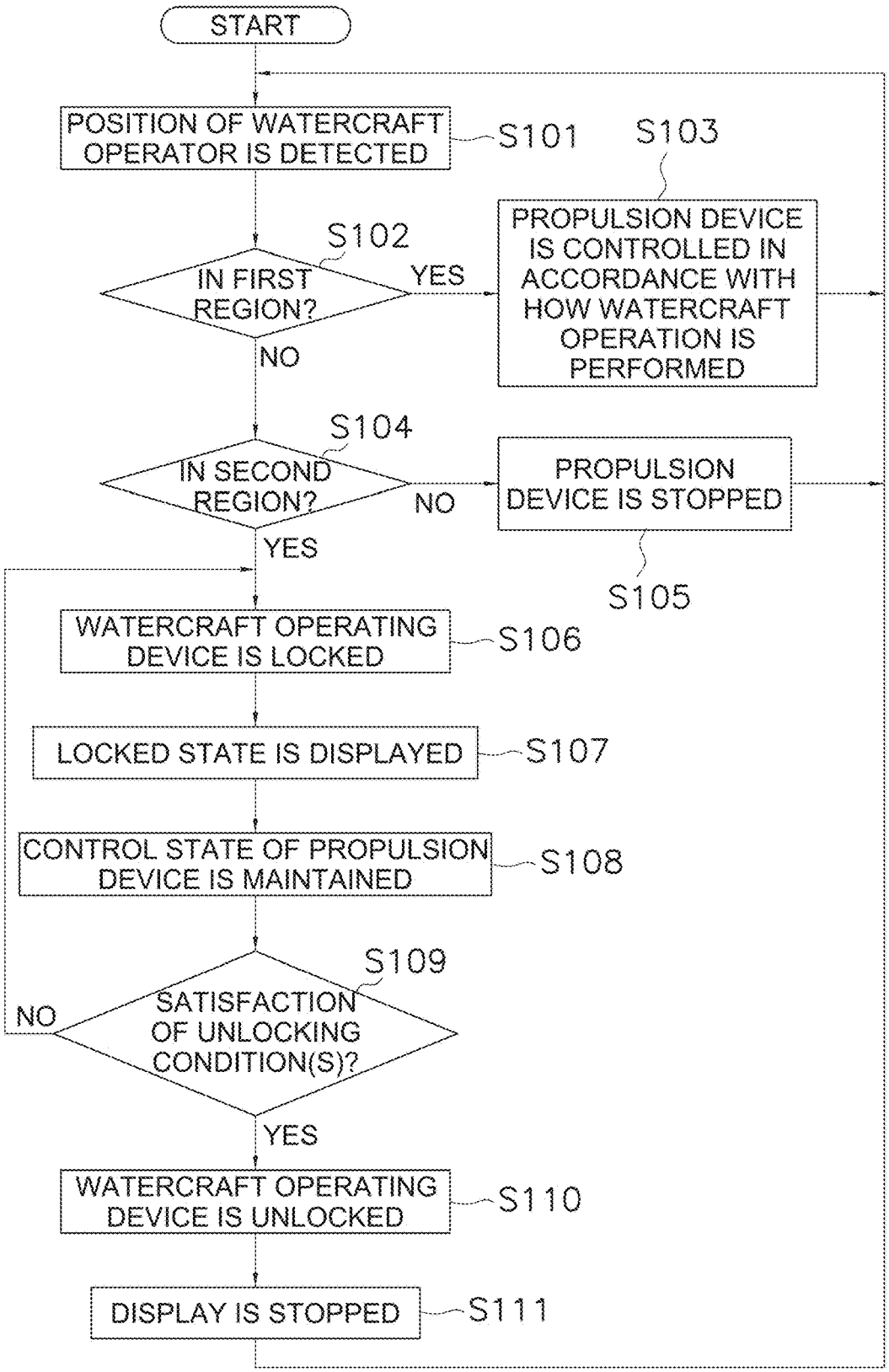
FIG. 3 is a flowchart showing a series of processes of a control to prevent a marine propulsion device from being erroneously operated in a first practical example.

FIG. 3 is a flowchart showing a series of processes of a control to prevent the marine propulsion device 3 from being erroneously operated in a first practical example. As shown in FIG. 3, in step S101, the controller 30 detects the location of the watercraft user H1. The controller 30 detects the location of the watercraft user H1 based on the radio wave signals transmitted from the first transmitter 21.

Figure 4:
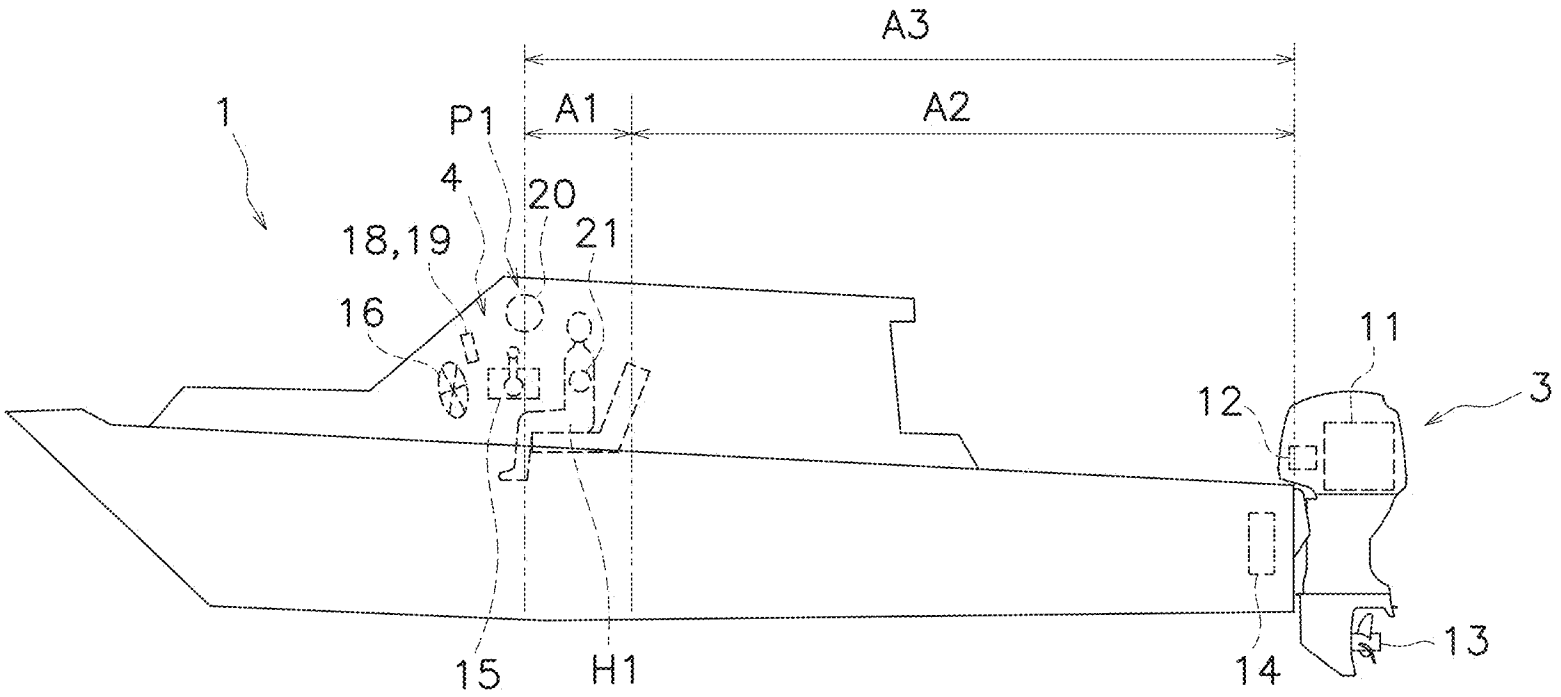
FIG. 4 is a side view of the watercraft showing an allowed area, a first region, and a second region.

In step S102, the controller 30 determines whether the watercraft user H1 is in a first region A1. As shown in FIG. 4, the first region A1 includes the watercraft operating position P1. The first region A1 is a peripheral region around the watercraft operating position P1. The first region A1 is a range of a predetermined distance from the watercraft operating position P1. The predetermined distance may fall in a range of, for instance, 60±12 inches.

When it is determined that the watercraft user H1 is in the first region A1, the controller 30 controls the marine propulsion device 3 in accordance with how the watercraft operation is performed in step S103. For example, the controller 30 controls the output of the marine propulsion device 3 in accordance with the operating position of the throttle lever 17. The controller 30 changes the rudder angle of the marine propulsion device 3 in accordance with the operation of the steering operator 16.

When the controller 30 determines that the watercraft user H1 is not in the first region A1 in step S102, the process proceeds to step S104. In step S104, the controller 30 determines whether the watercraft user H1 is in a second region A2. The second region A2 is farther from the watercraft operating position P1 than the first region A1 but within an allowed area A3.

As shown in FIG. 4, the allowed area A3 includes the first region A1 and the second region A2. The second region A2 is larger than the first region A1. The allowed area A3 is an area defined as within the watercraft 1. When the watercraft user H1 is not in the second region A2 or the first region A1, the controller 30 determines that the watercraft user H1 is not in the allowed area A3. For example, when the watercraft user H1 falls into the water, the controller 30 determines that the watercraft user H1 is not in the allowed area A3. In this case, the controller 30 stops the marine propulsion device 3 in step S105.

When it is determined that the watercraft user H1 is in the second region A2, the controller 30 freezes or locks the watercraft operator 4 in step S106. The controller 30 disables any operation performed on the watercraft operator 4 while the watercraft operator 4 is locked.

In step S107, the controller 30 causes the display 18 to display that the watercraft operator 4 is locked. In other words, the controller 30 outputs a representation, indicating that the watercraft operator 4 is locked, to the display 18. The representation, indicating that the watercraft operator 4 is locked, is displayed on the display 18 may be, for instance, an image or text. Alternatively, the representation, indicating that the watercraft operator 4 is locked, may be lighting a warning light.

After the watercraft operator 4 is locked, the controller 30 maintains a control state of the marine propulsion device 3 in step S108. In other words, the controller 30 maintains a state of the marine propulsion device 3 controlled in accordance with how the watercraft operator 4 has been operated before the watercraft operator 4 is locked. Even if the watercraft operator 4 is operated after the watercraft operator 4 is locked, the controller 30 maintains the control state of the marine propulsion device 3.

For example, even if the throttle lever 17 is operated after the watercraft operator 4 is locked, the controller 30 maintains the output of the marine propulsion device 3 produced in accordance with the operating position of the throttle lever 17 set before the watercraft operator 4 is locked. Even if the steering operator 16 is operated after the watercraft operator 4 is locked, the controller 30 maintains the rudder angle of the marine propulsion device 3 changed in accordance with the operating position of the steering operator 16 set before the watercraft operator 4 is locked.

In step S109, the controller 30 determines whether one or more conditions to unlock have been satisfied. When it is determined that the one or more conditions to unlock have been satisfied, the controller 30 unlocks the watercraft operator 4 in step S110. After unlocking the watercraft operator 4, the controller 30 causes the display 18 to stop displaying that the watercraft operator 4 is locked in step S111.

The one or more conditions to unlock include, for instance, a condition that the watercraft user H1 is in the first region A1 and a condition that the throttle lever 17 is set in the neutral position. Therefore, when the watercraft user H1 has returned to the first region A1 and the throttle lever 17 is returned to the neutral position, the controller 30 unlocks the watercraft operator 4. Accordingly, in steps S101, S102, and S103, the controller 30 controls again the marine propulsion device 3 in accordance with how the watercraft operation is performed.

Figure 5:
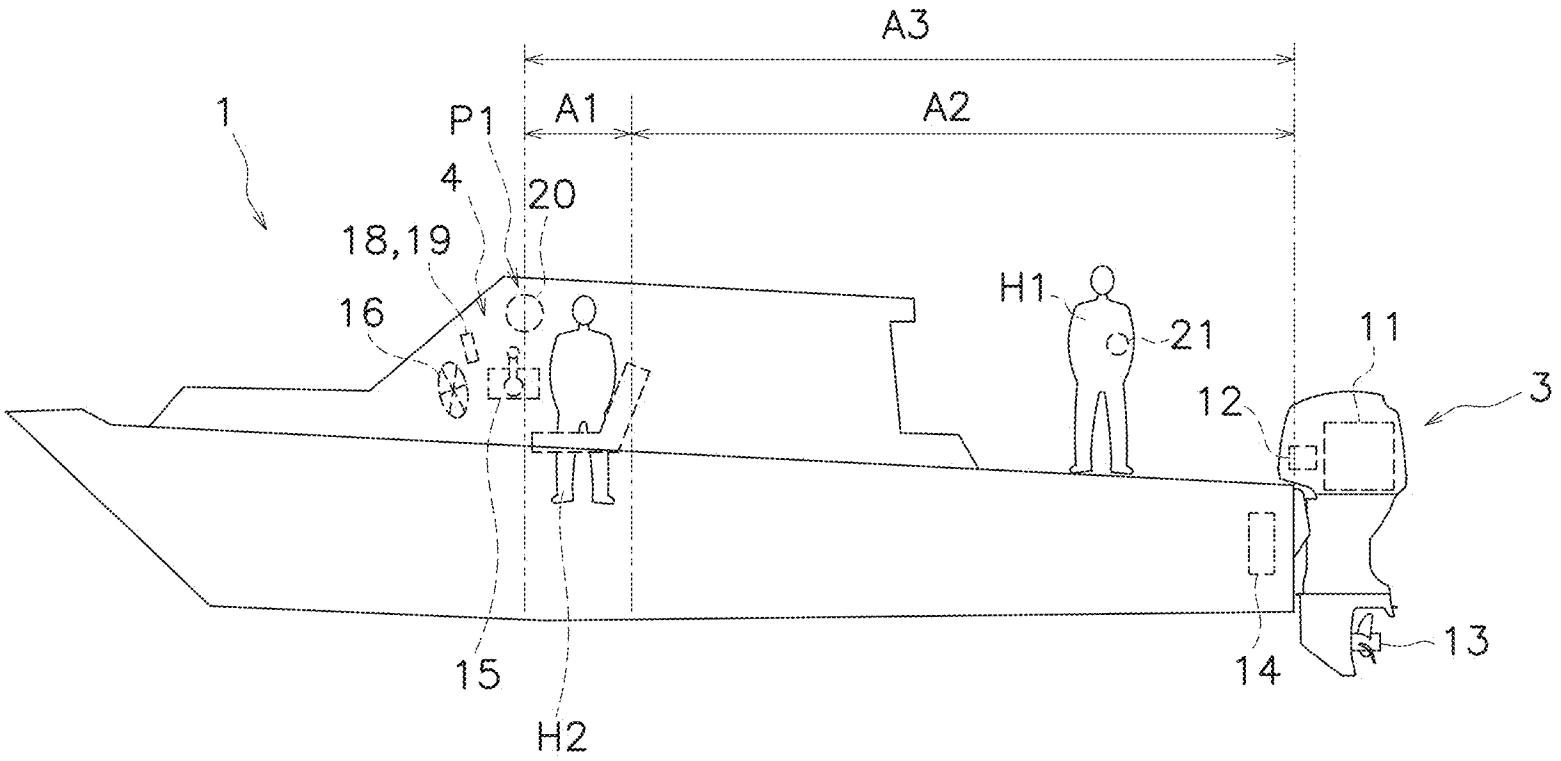
FIG. 5 is a side view of the watercraft showing the allowed area, the first region, and the second region.

In the system 2 according to the example embodiments explained above, when the watercraft user H1 is not in the allowed area A3, the marine propulsion device 3 is stopped. The watercraft 1 can be thus stopped when the watercraft user H1 encounters an abnormal situation such as falling into the water. On the other hand, as shown in FIG. 5, when the watercraft user H1 is in the second region A2 farther from the watercraft operating position P1 than the first region A1 but within the allowed area A3, the watercraft operator 4 is locked such that operation performed on the watercraft operator 4 is disabled. Because of this, even if another person-on-board H2 not equipped with a transmitter erroneously touches the watercraft operator 4 while the watercraft user H1 is away from the watercraft operating position P1, the operation performed for the watercraft operator 4 is disabled. Accordingly, the marine propulsion device 3 is inhibited from being erroneously operated.

Some of the example embodiments of the present invention have been explained above. However, the present invention is not limited to the example embodiments described above, and a variety of changes can be made without departing from the gist of the present invention.

The configuration of either the watercraft 1 or the system 2 for controlling the watercraft 1 is not limited to that in the example embodiments described above and may be changed. For example, the marine propulsion device 3 is not limited to the outboard motor, and alternatively, may be another type of propulsion device such as an inboard engine outboard drive or a jet propulsion device. The marine propulsion device 3 is not limited in number to one, and alternatively, may be two or greater. The watercraft operator 4 is not limited to that in the example embodiments described above and may be changed. For example, the watercraft operator 4 may include a joystick or other type of input interface or controller.

The sensor 20 is not limited to the receiver that receives the radio wave signals transmitted from the first transmitter 21, and may be changed. For example, the sensor 20 may include a camera. Based on image recognition by the camera, the controller 30 may determine whether the watercraft user H1 is in the first region A1, the second region A2, or the allowed area A3.

The series of processes of a control to prevent the marine propulsion device 3 from being erroneously operated is not limited to those in the example embodiments described above and may be changed. For example, when the watercraft user H1 is not in the allowed area A3, the controller 30 may control the marine propulsion device 3 to decelerate the watercraft 1 in step S105.

In the example embodiments described above, the controller 30 ignores any operation performed on the watercraft operator 4 while the watercraft operator 4 is locked. However, ignoring any operation performed on the watercraft operator 4 is not necessarily required to disable any operation performed on the watercraft operator 4 while the watercraft operator 4 is locked. Executing a control different from that executed in accordance with any operation performed on the watercraft operator 4 or lowering the responsiveness to any operation performed on the watercraft operator 4 may disable any operation performed on the watercraft operator 4 while the watercraft operator 4 is locked.

Figure 6:
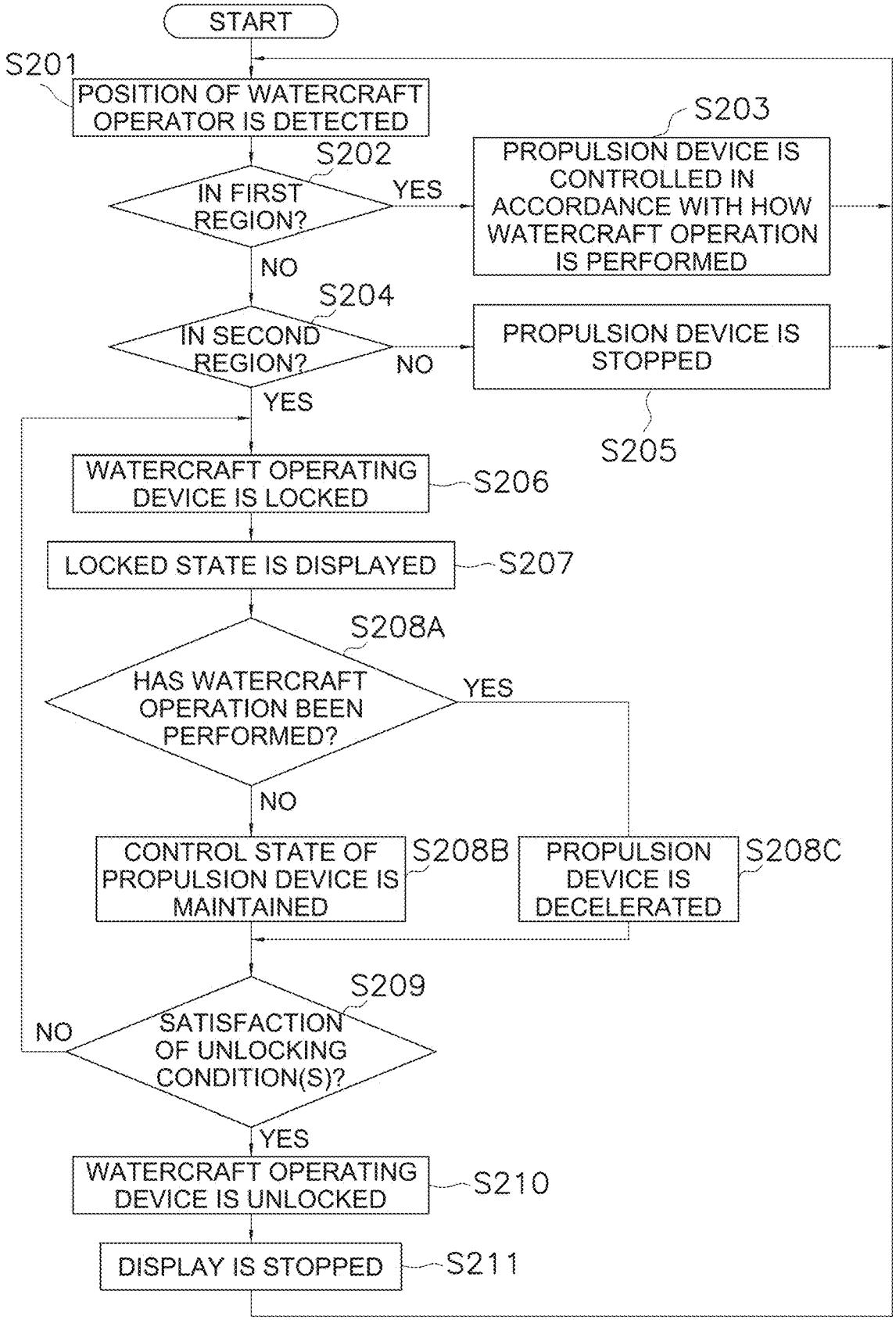
FIG. 6 is a flowchart showing a series of processes of a control to prevent the marine propulsion device from being erroneously operated in a second practical example.

For example, when the watercraft operator 4 is operated while locked, the controller 30 may stop the marine propulsion device 3 or control the marine propulsion device 3 to decelerate the watercraft 1. FIG. 6 is a flowchart showing a series of processes of a control to prevent the marine propulsion device 3 from being erroneously operated in a second practical example.

In FIG. 6, steps S201 to S207 are comparable to steps S101 to S107 in the first practical example. When the watercraft user H1 is in the second region A2, the controller 30 locks the watercraft operator 4 in step S206. After locking the watercraft operator 4, the controller 30 determines whether the watercraft operator 4 has been operated in step S208A.

When the watercraft operator 4 has not been operated after being locked, the controller 30 maintains the control state of the marine propulsion device 3 in step S208B in comparable manner to step S108 in the first practical example. When the watercraft operator 4 has been operated after being locked, the controller 30 decelerates the marine propulsion device 3 in step S208C. In this case, the one or more condition to unlock may include a condition that the moving speed of the watercraft 1 has reduced to a predetermined value. Alternatively, when the watercraft operator 4 has been operated after being locked, the controller 30 may stop the marine propulsion device 3 in step S208C. Remaining steps S209 to S211 are comparable to steps S109 to S111 in the first practical example.

Figure 7:
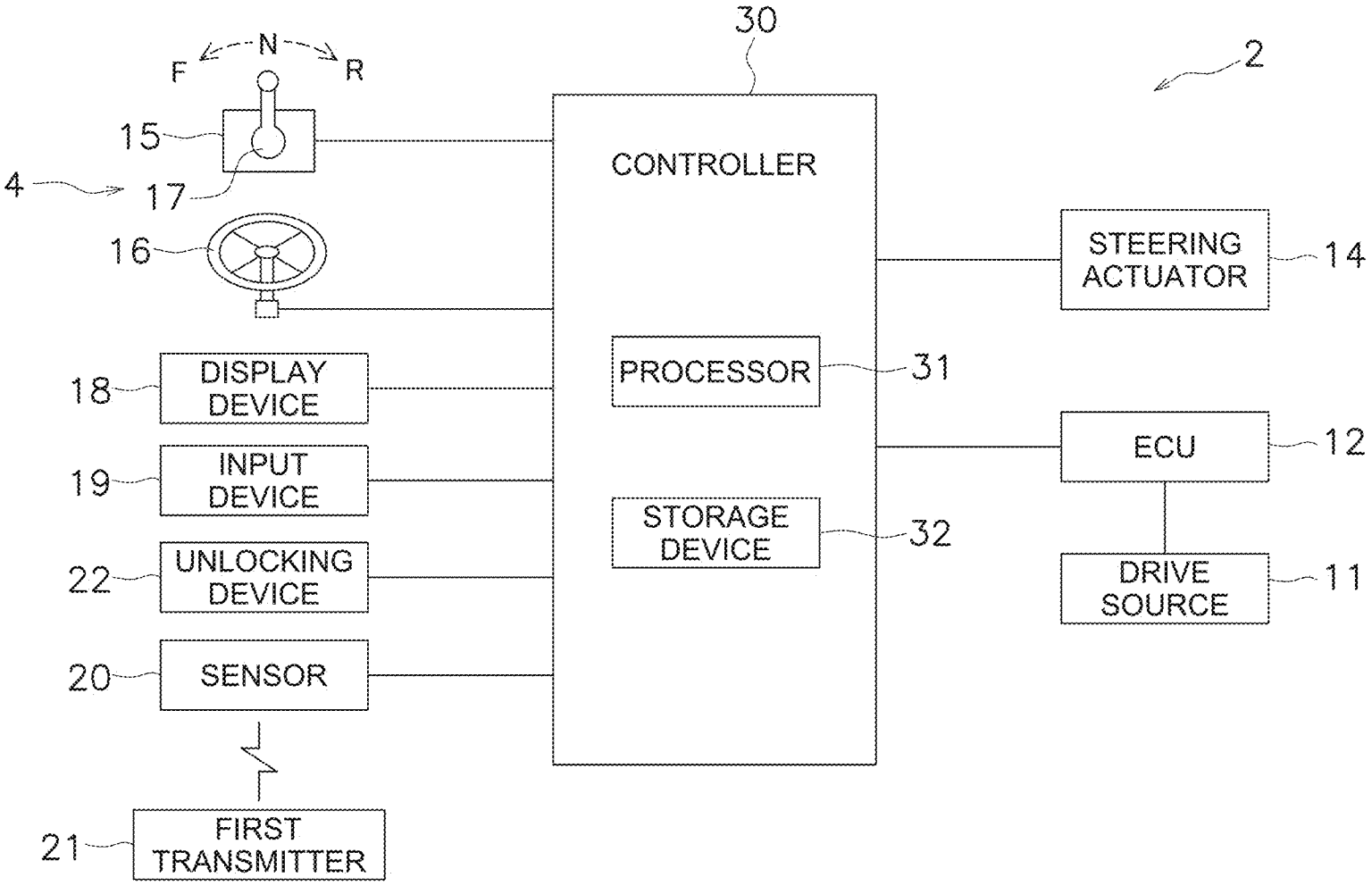
FIG. 7 is a block diagram showing a configuration of a system for controlling a watercraft in a first modified example.

The one or more conditions to unlock are not limited to that or those in each of the practical examples described above and may be changed. For example, FIG. 7 is a block diagram showing a configuration of the system 2 for controlling the watercraft 1 in a first modified example. As shown in FIG. 7, the watercraft 1 may include an unlocking device 22. The unlocking device 22 may include, for instance, one or more switches such as one or more buttons. The one or more conditions to unlock may include a condition that the unlocking device 22 is operated. When the unlocking device 22 is operated while the watercraft operator 4 is locked, the controller 30 may unlock the watercraft operator 4.

Figure 8:
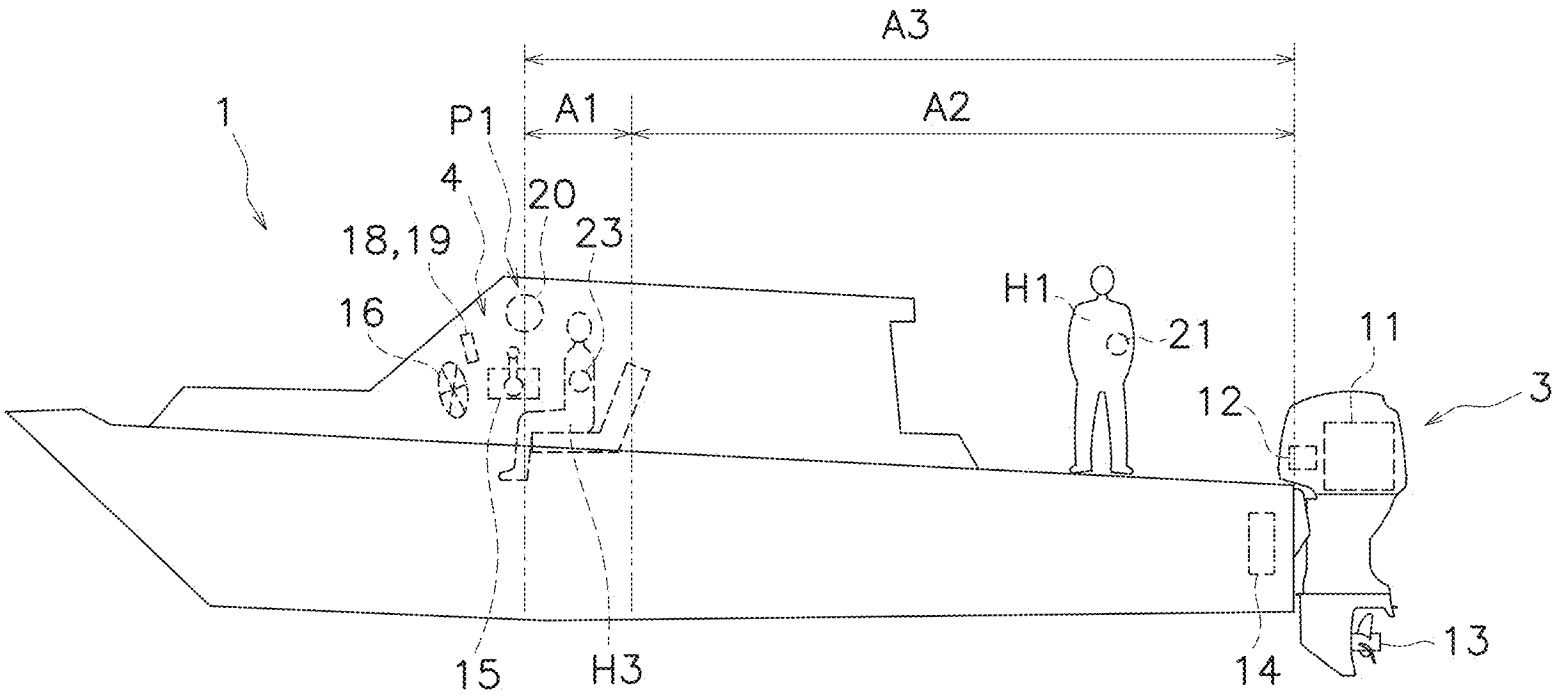
FIG. 8 is a side view of a watercraft showing a configuration of a system for controlling a watercraft in a second modified example.

FIG. 8 is a side view of the watercraft 1 showing a configuration of the system 2 for controlling the watercraft 1 in a second modified example. The system 2 may further include a second transmitter 23 with which another watercraft user (hereinafter referred to as an auxiliary watercraft user) H3 is equipped. The one or more conditions to unlock may include a condition that the second transmitter 23 is in the first region A1. When the second transmitter 23 is in the first region A1 after the watercraft operator 4 is locked, the controller 30 may unlock the watercraft operator 4.

For example, even if the first transmitter 21 is in the second region A2 after the watercraft operator 4 is locked, the controller 30 may unlock the watercraft operator 4 when the second transmitter 23 is in the first region A1. Accordingly, even if the watercraft user H1, equipped with the first transmitter 21, is in the second region A2, the watercraft operator 4 is unlocked when the auxiliary watercraft user H3, equipped with the second transmitter 23, is in the first region A1. Therefore, even if the watercraft user H1 is in the second region A2, the auxiliary watercraft user H3 is enabled to operate the watercraft 1 with the watercraft operator 4.

According to example embodiments of the present invention, it is possible to stop or decelerate a watercraft when a watercraft user falls into the water and to inhibit a marine propulsion device from being erroneously operated when the watercraft user is away from a watercraft operating position.

While example embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A system for controlling a watercraft including a marine propulsion device and a watercraft operator operable by a watercraft user of the watercraft at a watercraft operating position in the watercraft, the system comprising:

a sensor to detect a location of the watercraft user; and a controller configured or programmed to:

determine whether the watercraft user is in an allowed area that includes the watercraft operating position;

stop the marine propulsion device or control the marine propulsion device to decelerate the watercraft when the watercraft user is not in the allowed area;

determine whether the watercraft user is in a first region within the allowed area;

control the marine propulsion device in accordance with how the watercraft operator is operated when the watercraft user is in the first region;

determine whether the watercraft user is in a second region farther from the watercraft operating position than the first region but within the allowed area;

lock the watercraft operator when the watercraft user is in the second region; and disable an operation performed on the watercraft operator while the watercraft operator is locked; wherein when the watercraft operator is operated while locked, the controller is configured or programmed to stop the marine propulsion device or control the marine propulsion device to decelerate the watercraft.

2. The system according to claim 1, wherein when the watercraft user is returned to the first region after the watercraft operator is locked, the controller is configured or programmed to unlock the watercraft operator.

3. The system according to claim 2, wherein the watercraft operator includes a throttle lever operable from a neutral position; and after the throttle lever is operated while the watercraft operator is locked, the controller is configured or programmed to unlock the watercraft operator when the throttle lever is returned to the neutral position while the watercraft user is in the first region.

4. The system according to claim 1, wherein the watercraft includes a display; and when the watercraft operator is locked, the controller is configured or programmed to cause the display to output a representation indicating that the watercraft operator is locked.

5. The system according to claim 1, wherein the watercraft includes an unlocking device; and when the unlocking device is operated while the watercraft operator is locked, the controller is configured or programmed to unlock the watercraft operator.

6. The system according to claim 1, further comprising:

a first transmitter to be worn by the watercraft user; wherein the sensor is operable to receive wireless signals transmitted from the first transmitter at the watercraft operating position; and the controller is configured or programmed to detect a location of the first transmitter as the location of the watercraft user based on a communication between the sensor and the first transmitter.

7. The system according to claim 1, further comprising:

a second transmitter to be worn by another watercraft user; wherein when the second transmitter is in the first region after the watercraft operator is locked, the controller is configured or programmed to unlock the watercraft operator.

8. A method of controlling a watercraft including a marine propulsion device and a watercraft operator operable by a watercraft user of the watercraft at a watercraft operating position in the watercraft, the method comprising:

detecting a location of the watercraft user;

determining whether the watercraft user is in an allowed area including the watercraft operating position;

stopping the marine propulsion device or controlling the marine propulsion device to decelerate the watercraft when the watercraft user is not in the allowed area;

determining whether the watercraft user is in a first region within the allowed area;

controlling the marine propulsion device in accordance with how the watercraft operator is operated when the watercraft user is in the first region;

determining whether the watercraft user is in a second region farther from the watercraft operating position than the first region but within the allowed area;

locking the watercraft operator when the watercraft user is in the second region;

disabling an operation performed on the watercraft operator while the watercraft operator is locked; and when the watercraft operator is operated while locked, stopping the marine propulsion device or controlling the marine propulsion device to decelerate the watercraft.

9. The method according to claim 8, further comprising:

when the watercraft user has returned to the first region after the watercraft operator is operated while locked, unlocking the watercraft operator.

10. The method according to claim 9, wherein the watercraft operator includes a throttle lever operable from a neutral position, the method further comprising:

after the throttle lever is operated while the watercraft operator is locked, unlocking the watercraft operator when the throttle lever is returned to the neutral position while the watercraft user is in the first region.

11. The method according to claim 8, wherein the watercraft includes a display, the method further comprising:

when the watercraft operator is locked, causing the display to output a representation indicating that the watercraft operator is locked.

12. The method according to claim 8, wherein the watercraft includes an unlocking device, the method further comprising:

when the unlocking device is operated while the watercraft operator is locked, unlocking the watercraft operator.

13. The method according to claim 8, further comprising:

receiving wireless signals transmitted from a first transmitter to be worn by the watercraft user; and detecting a position of the first transmitter as the location of the watercraft user based on the wireless signals transmitted from the first transmitter.

14. The method according to claim 13, further comprising:

receiving wireless signals transmitted from a second transmitter to be worn by another watercraft user; and when the second transmitter is in the first region after the watercraft operator is locked, unlocking the watercraft operator.

* * * * *